US005213079A

United States Patent [19]

Umemoto et al.

[11] Patent Number: 5,213,079

[45] Date of Patent: May 25, 1993

[54] IGNITION TIMING CONTROL APPARATUS

[75] Inventors: Hideki Umemoto; Hiroshi Okuda, both of Himeji, Japan

[73] Assignee: Mitsubishi Denki K.K., Tokyo, Japan

[21] Appl. No.: 877,389

[22] Filed: Apr. 30, 1992

Related U.S. Application Data

[63] Continuation of Ser. No. 637,841, Jan. 7, 1991, abandoned.

[30] Foreign Application Priority Data

Jan. 17, 1990 [JP] Japan ..... 2-6330

[51] Int. Cl.[5] ..... F02P 7/067; F02P 11/00

[52] U.S. Cl. ..... 123/414

[58] Field of Search ..... 123/414, 479, 198 D

[56] References Cited

U.S. PATENT DOCUMENTS

| | | | |
|---|---|---|---|
| 4,485,784 | 12/1984 | Fujii et al. | 123/414 X |
| 4,494,518 | 1/1985 | Katayama et al. | 123/414 X |
| 4,583,176 | 4/1986 | Yamato et al. | 123/479 X |
| 4,658,786 | 4/1987 | Foss et al. | 123/414 |
| 4,664,082 | 5/1987 | Suzuki | 123/414 |
| 4,825,691 | 5/1989 | Sekiguchi | 123/479 X |

FOREIGN PATENT DOCUMENTS 14238 2/1978 Japan .

*Primary Examiner*—Tony M. Argenbright
*Attorney, Agent, or Firm*—Sughrue, Mion, Zinn, Macpeak & Seas

[57] ABSTRACT

An ignition timing control device for an internal combustion engine includes an ignition signal coil for producing a first pulse signal in synchronism with the revolution of the engine and in correspondence to a predetermined crank angle position, a crank angle sensor for producing a second pulse signal in synchronism with the revolution of the crank, the second pulse signal having a greater frequency than said first pulse signal, and a microcomputer for performing an ignition control of the engine by detecting the crank angle on the basis of the first and second pulse signals. The microcomputer is adapted to perform an ignition control by another means when an abnormal state of the crank angle sensor is detected from the second pulse signal.

3 Claims, 5 Drawing Sheets

IGNITION TIMING CONTROL APPARATUS

This is a continuation of application Ser. No. 07/637,841 filed Jan. 7, 1991, now abandoned.

BACKGROUND OF THE INVENTION

1. Field of the Invention

The present invention relates to an ignition timing control apparatus for an internal combustion engine used for, for instance, an outboard machine.

2. Discussion of Background

In a conventional ignition timing control apparatus, a crank angle was detected on the basis of a signal from a crank angle sensor which produces every 1°, for instance, a signal, and the ignition of engine was performed at the optimum angle on the basis of the detected crank angle.

In the conventional ignition timing control apparatus, however, when the crank angle sensor became abnormal because of disconnection of wire, a short circuit or the like, information of the crank angle was not provided and ignition control became impossible, resulting in an engine stop. If such problem occurs in an outboard machine with the ignition timing control apparatus in a ship on the sea, there is a danger that the ship can not return to a harbor.

SUMMARY OF THE INVENTION

It is an object of the present invention to provide an ignition timing control apparatus capable of performing an ignition control for the engine even when a crank angle sensor becomes faulty.

The foregoing and other objects of the present invention have been attained by providing an ignition timing control apparatus for an internal combustion engine which comprises, an ignition signal coil for producing a first pulse signal in synchronism with the revolution of the engine and in correspondence to a predetermined crank angle position, a crank angle sensor for producing a second pulse signal in synchronism with the revolution of the crank, the second pulse signal having a greater frequency than said first pulse signal, and a microcomputer for performing an ignition control of the engine by detecting the crank angle on the basis of said first and second pulse signals, said microcomputer being adapted to perform an ignition control by another means when an abnormal state of the crank angle sensor is detected from said second pulse signal.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
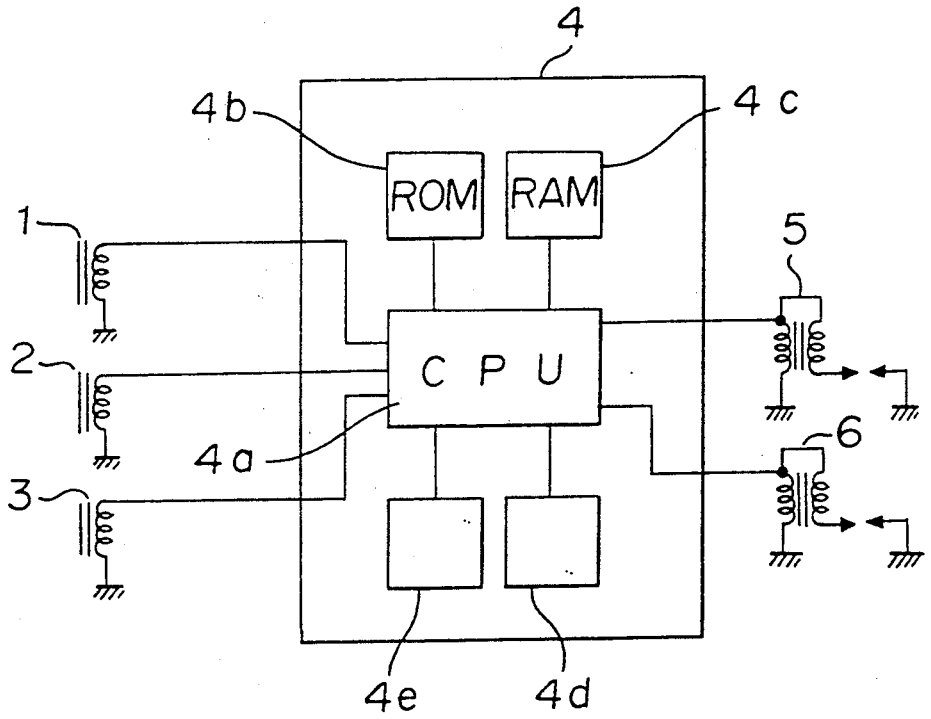
FIG. 1 is a block diagram which is common to first and second embodiments of the ignition timing control apparatus according to the present invention.

Referring to the drawings, wherein the same reference numerals designate the same or corresponding parts throughout several views, and more particularly to FIG. 1 thereof there is shown a block diagram which is used commonly for explanation of first and second embodiments.

In FIG. 1, the ignition timing control apparatus according to the first and second embodiments of the present invention comprises a crank angle sensor 1, an ignition signal coil 2 for the first cylinder, an ignition signal coil 3 for the second cylinder, a microcomputer 4 connected to the crank angle sensor 1 and the ignition signal coils 2, 3, and ignition coils 5, 6 connected to the microcomputer 4. The microcomputer 4 includes a CPU 4*a*, an ROM 4*b*, an RAM 4*c*, a sensor abnormality counter 4*d* and an ignition counter 4*e*.

Figure 2:
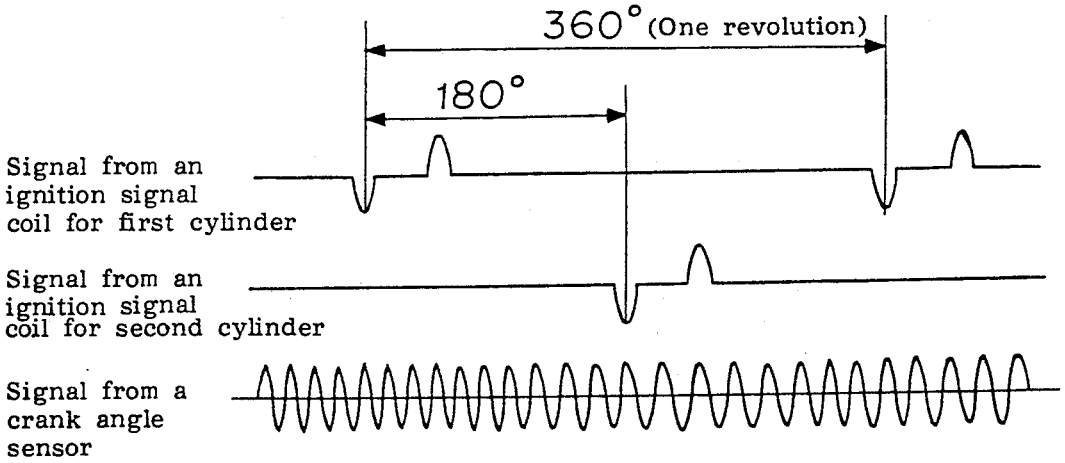
FIG. 2 is a waveform diagram of signals showing the operation of the first and second embodiments of the present invention.

In the next, the operation of the first embodiment will be described with reference to FIG. 2 and 3 wherein FIG. 2 is a waveform diagram of signals showing the operation of the first embodiment and FIG. 3 is a flow chart showing the operation of the first embodiment of the present invention.

The main program (not shown) stored in the microcomputer 4 governs the retrieval of ignition timing from a map and control for injectors. Since the main program is usually operated with a relatively long period (for instance, 10 ms), an ignition timing control which is usually operated with a relatively short period is conducted so as to interrupt the main program. Namely, the ignition reference signal interruption loop as in FIG. 3*a* is executed in the main program as soon as the pulse signal of the ignition signal coil 2 or 3 is produced.

Figure 3A:
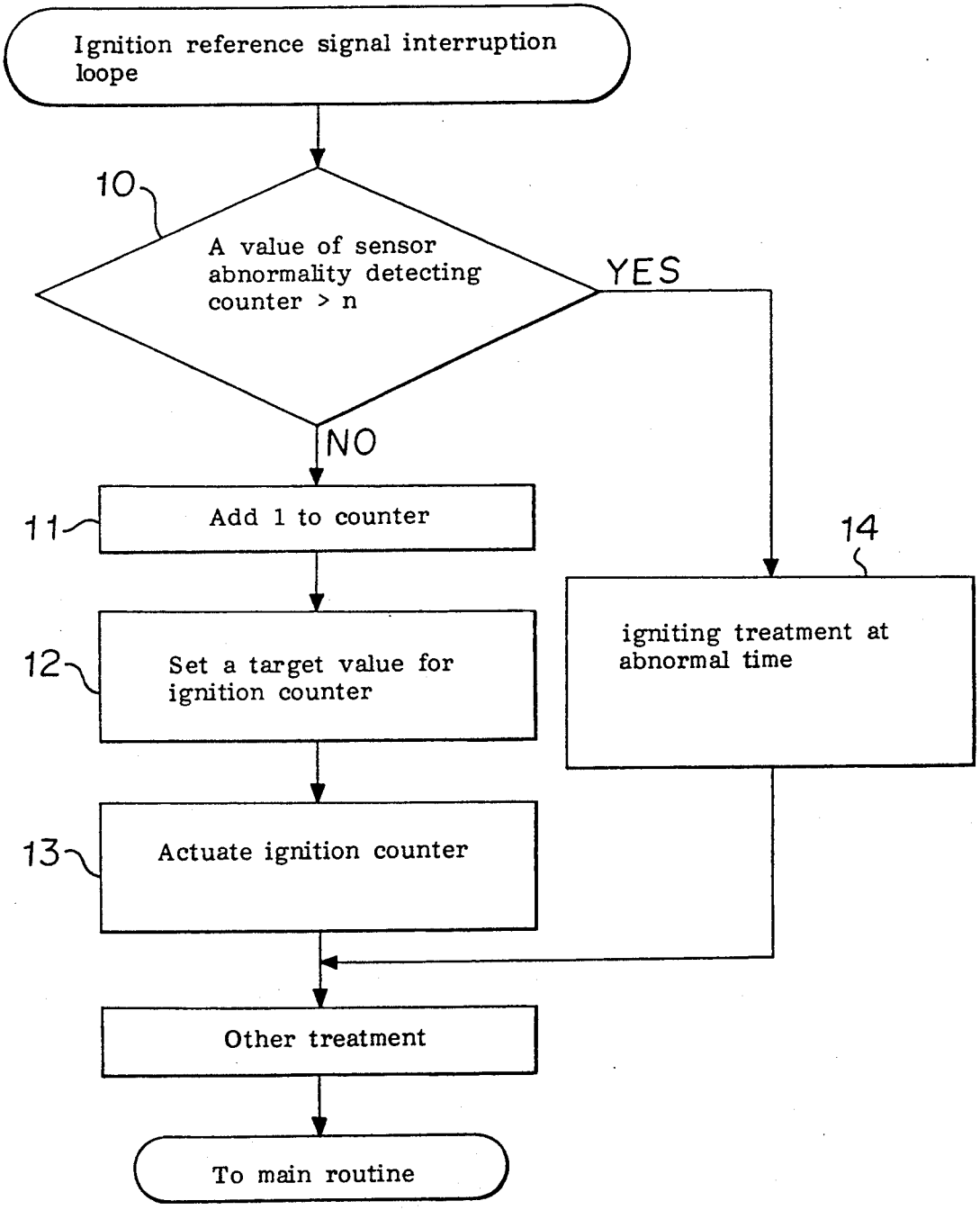
FIGS. 3*a* and 3*b* are flow charts showing the operation of the first embodiment of the present invention.

At Step 10 in FIG. 3*a*, determination is made as to whether or not the value of the sensor abnormality counter 4*c* is equal to or higher than a predetermined value n. When the determination is negative, the sequential step goes to Step 11. When the determination is affirmative, the treatment of Step 14 is taken.

At Step 11, a figure "1" is added to the value of the sensor abnormality counter 4*d*.

At Step 12, the target count value corresponding to the optimum ignition timing in the main program is read so that a target value for the ignition counter 4*e* is set.

At Step 13, counting of the ignition counter 4*e* is initiated. Then, other treatments (such as control of over-revolution and so on) are executed, and then, the operation of the main program is again taken.

Figure 3B:
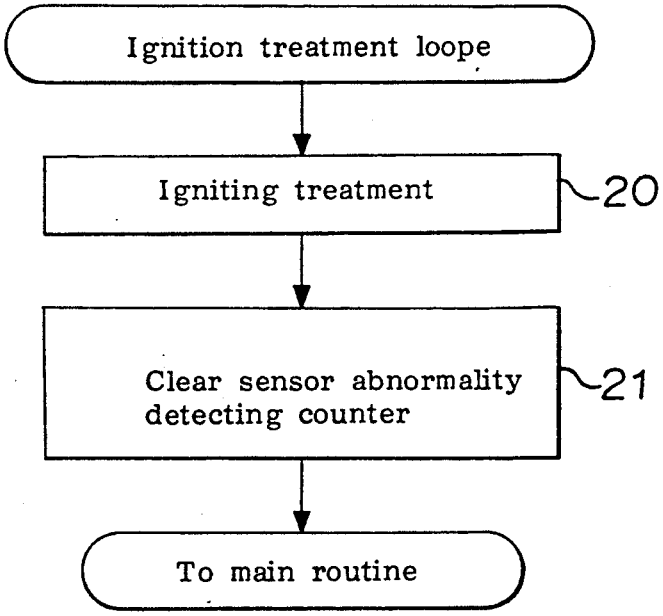

On the other hand, the ignition counter 4*e* counts the number of pulses of the pulse signal from the crank angle sensor 1. When a counted value reaches a target value, the operation is transferred to an ignition treatment loop as shown in FIG. 3*b* in which the engine is ignited (Step 20) and the sensor abnormality counter 4*d* is cleared (Step 21). Then, the operation is returned to the main program.

During the operation of the engine, if an abnormal state occurs in the crank angle sensor 1, it does not generate any pulse signal. Then, the count value of the ignition counter 4*e* does not reach the target value and the transfer to the ignition treatment loop is prohibited, whereby the sensor abnormality counter 4*d* is not cleared. Accordingly, the value of the sensor abnormality counter is accumulated each time when the ignition reference signal interruption loop is actuated by the generation of the pulse signal from the ignition signal coil 2 or 3. When the value accumulated in the sensor abnormality counter reaches the predetermined value n, the operation of Step 14 is taken.

At step 14, an ignition treatment at an abnormal time is executed. Namely, the ignition of the engine is controlled by forecasting time. For instance, when the ignition control of the engine is to be conducted at a predetermined crank angle $\theta$ by measuring a period T through the pulse signals of the ignition signal coils 2, 3 for the first and second cylinders, a formula $T \cdot \theta/360°$ is obtainable from the pulse signals of the ignition signal coils 2, 3 and the ignition control is conducted after the lapse of time of $T \cdot \theta/360°$. In this case, when $\theta = 10°$, the ignition control is conducted after the lapse of time of T/36. Then, other treatments are executed and the operation is returned to the main routine. During the ignition control, a misfiring state temporarily takes place in the course from the ordinary ignition treatment to the ignition treatment at an abnormal time. However, such misfiring state is in a very short time and there is no problem in the operation of the engine.

The operation of the second embodiment of the present invention will be described with reference to FIGS. 2 and 4.

Figure 4:
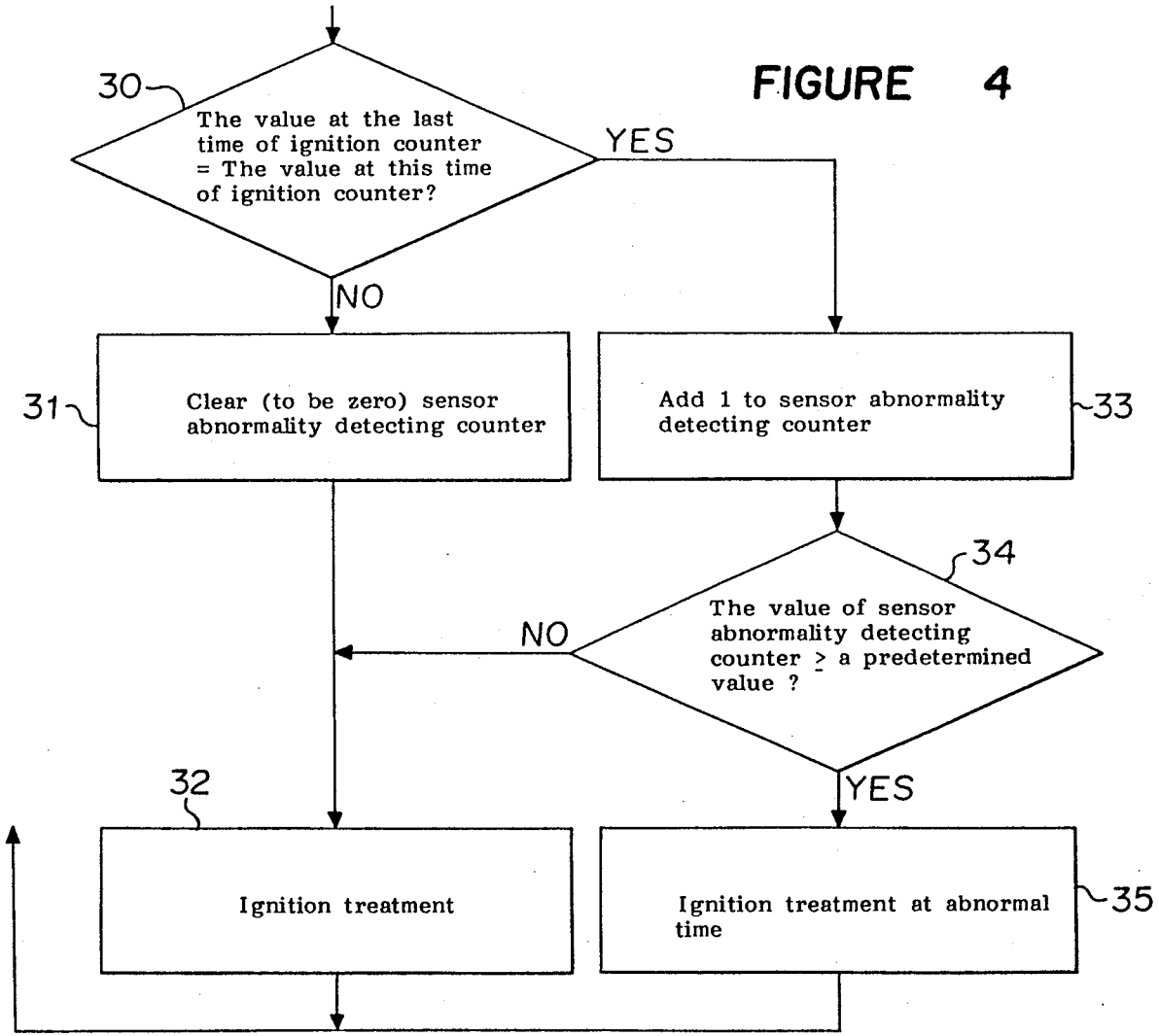
FIG. 4 is a flow chart showing the operation of the second embodiment of the present invention.

FIG. 4 is a flow chart showing the operation of the second embodiment of the present invention.

In the ignition timing control apparatus of the second embodiment of the present invention, the pulse signals of the crank angle sensor 1 are counted by the ignition counter 4*e* and ignition timing is determined on the basis of the counted pulse signals as in the same manner as first embodiment.

At Step 30, the microcomputer 4 checks a value of the ignition counter every predetermined time and judges whether or not the value detected at the last time is equal to the value detected at this time. When the values detected are equal, Step 33 is taken. When the values are different, the sequential step goes to Step 31.

At Step 31, the sensor abnormality detecting counter 4*d* is cleared. At Step 32, the ordinary ignition treatment is conducted in the same manner as the first embodiment. Then, sequential step is returned to Step 30.

When the values detected are different, a figure "1" is added to the sensor abnormality detecting counter at Step 33.

At Step 34, determination is made as to whether or not the value of the sensor abnormality detecting counter 4*d* is a predetermined value or higher. When the determination affirmative, the ignition treatment at abnormal time is conducted at Step 35. Otherwise, the ordinary ignition treatment is conducted at Step 32.

At Step 35, the ignition treatment at an abnormal time is conducted in the same manner as the first embodiment. Thereafter, the sequential step is returned to Step 30.

In the first and second embodiments of the present invention, when the abnormality of the crank angle sensor 1 is detected, the ignition treatment without using the crank angle sensor 1 is conducted separate from the ordinary ignition treatment, and accordingly, engine stop due to the abnormality of the crank angle sensor 1 can be prevented. Therefore, when the ignition timing control apparatus of the present invention is used for an outboard engine, a ship provided with the outboard engine can return to a harbor even when the crank angle sensor becomes an abnormal state, whereby the safeness can be remarkably improved.

In the above-mentioned embodiments, the reason why the ignition treatment at an abnormal time is conducted only when the value of the sensor abnormality detecting counter is a predetermined value (for instance, the value corresponding two revolutions) or higher is to assure that temporary abnormal state in signal such as a mere contact failure in the crank angle sensor 1 is not deemed as an abnormal state.

The predetermined time as used in the second embodiment is a constant time of 5 m sec or a random non-constant time. Further, the same effect can be attained by the repetition of a combination of two or more kinds of constant time having different time widths.

In the above-mentioned embodiments, the ignition control at an abnormal time is conducted by forecasting time. However, the same effect can be obtained by igniting the engine when the pulse signals of the ignition signal coil 2 or 3 reach a predetermined level.

In the above-mentioned embodiments, the ignition timing control apparatus is applied to a two-cylinder engine. However, the present invention is applicable to another type of multi-cylinder engine.

Thus, in accordance with the present invention, the engine can be continuously operated at at least lowest level without causing engine stop even when the crank angle sensor becomes abnormal. Accordingly, reliability of the engine is improved and the safeness of the engine can be assured.

Obviously, numerous modifications and variations of the present invention are possible in light of the above teachings. It is therefore to be understood that within the scope of the appended claims, the invention may be practiced otherwise than as specifically described herein.

What is claimed is:

1. An ignition timing control apparatus for an internal combustion engine which comprises:

an ignition signal coil for producing a first pulse signal in synchronism with the revolution of the engine and in correspondence to a predetermined crank angle position, a crank angle sensor for producing a second pulse signal in synchronism with the revolution of the crank, the second pulse signal having a greater frequency than said first pulse signal, a control means for performing an ignition control of the engine by detecting the crank angle on the basis of said first and second pulse signals, said control means being adapted to perform an ignition control by another means when an abnormal state of the crank angle sensor is detected from said second pulse signal, and threshold means for enabling said control means to perform ignition control by said another means only when said crank angle sensor has been detected to be abnormal past a predetermined threshold of abnormality, wherein said threshold means operates under software control to check whether the crank angle is abnormal past said predetermined threshold of abnormality, by iteratively checking the value of a sensor abnormality counter, said threshold means comprising:

checking means for checking whether the contents of said sensor abnormality counter is greater than a predetermined value;

updating means for increasing the contents of said sensor abnormality counter when said checking means determines that the contents is not greater than said predetermined value;

abnormal ignition means for performing ignition when said checking means determines that said contents is greater than said predetermined value;

normal ignition means for performing ignition when said updating means increases the contents of said sensor abnormality counter; and clearing means for clearing to zero the contents of said sensor abnormality counter whenever said normal ignition means performs ignition.

2. The ignition timing control apparatus according to claim 1, wherein said ignition signal coil comprises first and second ignition signal coils.

3. An ignition timing control apparatus for an internal combustion engine which comprises:

an ignition signal coil for producing a first pulse signal in synchronism with the revolution of the engine and in correspondence to a predetermined crank angle position, a crank angle sensor for producing a second pulse signal in synchronism with the revolution of the crank, the second pulse signal having a greater frequency than said first pulse signal, a control means for performing an ignition control of the engine by detecting the crank angle on the basis of said first and second pulse signals, said control means being adapted to perform an ignition control by another means when an abnormal state of the crank angle sensor is detected from said second pulse signal, and threshold means for enabling said control means to perform ignition control by said another means only when said crank angle sensor has been detected to be abnormal past a predetermined threshold of abnormality, wherein said threshold means operates under software control to check whether the crank angle is abnormal past said predetermined threshold of abnormality, by iteratively checking the value of a sensor abnormality counter, said threshold means comprising:

ignition counter means for counting said second pulse signals;

checking means for checking the contents of said ignition counter means;

comparing means for comparing the present results of said checking means with past results of said checking means;

clearing means for clearing the contents of said sensor abnormality counter when said comparing means determines that said present results are not equal to said past results;

updating means for increasing the contents of said sensor abnormality counter when said comparing means determines that said past and present results are equal;

abnormality checking means for determining whether the contents of said sensor abnormality counter is greater than or equal to a predetermined value;

abnormal ignition means for performing ignition whenever said abnormality checking means determines that the contents of said sensor abnormality counter is greater than or equal to said predetermined value; and normal ignition means for performing ignition when said clearing means clears the contents of said sensor abnormality counter or when said abnormality checking means determines that the contents of said sensor abnormality counter is not greater than or equal to said predetermined value.

* * * * *